US005823897A

United States Patent [19]

Wang

[11] Patent Number: 5,823,897

[45] Date of Patent: Oct. 20, 1998

[54] BACKBOARD ASSEMBLY FOR BASKETBALL

[76] Inventor: Lian-Cheng Wang, No. 258-22, Hai Pin Road, Wu Lu Li, Ching Shui Chen, Taichung Hsien, Taiwan

[21] Appl. No.: 892,726

[22] Filed: Jul. 15, 1997

[51] Int. Cl.[6] ..... A63B 63/08

[52] U.S. Cl. ..... 473/481

[58] Field of Search ..... 473/481, 485, 473/488

[56] References Cited

U.S. PATENT DOCUMENTS 4,826,162 5/1989 Allen ..... 473/481

*Primary Examiner*—William H. Grieb
*Attorney, Agent, or Firm*—Beveridge, Degrandi, Weilacher & Young LLP

[57] ABSTRACT

A backboard assembly for basketball including a backboard being provided with an elongate slot in the lower middle portion. The back surface of the backboard is provided with a pair of projected sockets which are spaced apart from each other and each of the sockets is adjacent to the end portion of the elongate slot. Each of the sockets is provided with a shaft hole which is parallel to the longitudinal axis of the elongate slot. The elongate slot is further provided with a pair of cutouts which are spaced apart from each other and each of the cutouts is adjacent to the end portion of the elongate slot. A rim hoop ring defines an opening thereof. The opening is provided with a pair of mounting legs directed outward. Each of the mounting legs is further provided with a pin shaft which is pivotally received within the shaft hole of the socket of the backboard. Each of the mounting legs is further provided with a stopping boss at a top surface and a supporting leg at a bottom surface which are pressed against the front surface of the backboard when the rim hoop ring is pivotally mounted to the backboard by the pivotal engagement between of the pin shaft and the shaft hole.

4 Claims, 5 Drawing Sheets

BACKBOARD ASSEMBLY FOR BASKETBALL

FIELD OF THE INVENTION

The present invention relates to an improved backboard assembly, more particularly, to an improved backboard assembly for basketball in which the rim hoop ring can be readily and conveniently attached to the backboard without applying any fastening device therebetween. The backboard is provided with an elongate slot in the lower middle portion. The back surface of the backboard with a pair projected sockets which are provided with a shaft hole, respectively. The elongate slot is further provided with a pair of cutouts which are adjacent to the end portion of the elongate slot. A rim hoop ring defines an opening thereof. The opening is provided with a pair of mounting legs directed outward. Each of the mounting legs is further provided with a pin shaft which is pivotally received within the shaft hole of the socket of the backboard. Each of the mounting legs is further provided with a stopping boss at a top surface and a supporting leg at a bottom surface which are pressed against the front surface of the backboard when the rim hoop ring is pivotally mounted to the backboard by the pivotal engagement between the pin shaft and the shaft hole. When the backboard assembly is not in use, the rim hoop ring can be slightly compressed such that the projected boss can be received within the cutout of the elongate slot.

DESCRIPTION OF PRIOR ART

In the conventional backboard assembly for amateur or leisure basketball, it is configured by a backboard and rim hoop ring which are not for professional application and are made from plastic material. This conventional backboard assembly generally comprises a backboard, a rim hoop and ring, and a fastening device. In assembling, the fastening device is fixedly mounted onto a preset position of the backboard. However, this takes a great deal of time to attach the fastening device. Furthermore, if the locking torque is not accurately controlled, the plastic backboard can be readily deformed or damaged. On the other hand, the locking nut may readily become loose after a period of usage. Besides, since the conventional backboard assembly is completely made from plastic material, it has a poor shock-absorbing capability. If an overloaded impact is exerted to the backboard, the rim hoop ring and/or backboard may be readily damaged or broken. Besides, during the assembly of the components, a screw driver or spanner shall be applied for locking the fastening device. This is really inconvenient for the user and after the locking and snapping procedures repetitively, the durability becomes poor and poor. After a period of usage, the rim hoop ring will incline downward which is not good for shooting.

SUMMARY OF THE INVENTION

It is the objective to provide an improved backboard assembly for basketball wherein the rim hoop ring can be readily assembled to the backboard in a snapped manner. During the assembling, no fastening device, such as bolts and nuts, is applied. As a result, the assembly work can be readily done and the manufacturing cost is reduced and the throughput is increased.

In order to achieve the objective set forth, the backboard assembly for basketball made according to the present invention include a backboard which is provided with an elongate slot in the lower middle portion. The back surface of the backboard is provided with a pair of projected sockets which are spaced apart from each other and each of the sockets is adjacent to the end portion of the elongate slot. Each of the sockets is provided with a shaft hole which is parallel to the longitudinal axis of the elongate slot. The elongate slot is further provided with a pair of cutouts which are spaced apart from each other and each of the cutouts is adjacent to the end portion of the elongate slot. A rim hoop ring defines an opening thereof. The opening is provided with a pair of mounting legs directed outward. Each of the mounting legs is further provided with a pin shaft which is pivotally received within the shaft hole of the socket of the backboard. Each of the mounting legs is further provided with a stopping boss at a top surface and a supporting leg at a bottom surface which are pressed against the front surface of the backboard when the rim hoop ring is pivotally mounted to the backboard by the pivotal engagement between the pin shaft and the shaft hole.

According to one aspect of the present invention, the stopping boss can be suitably received within the cutout of the elongate slot when the rim hoop ring is pivotally stored.

BRIEF DESCRIPTION OF THE DRAWINGS

In order that the present invention may more readily be understood the following description is given, merely by way of example with reference to the accompanying drawings, in which.

DETAILED DESCRIPTION OF PREFERRED EMBODIMENT

Figure 1:
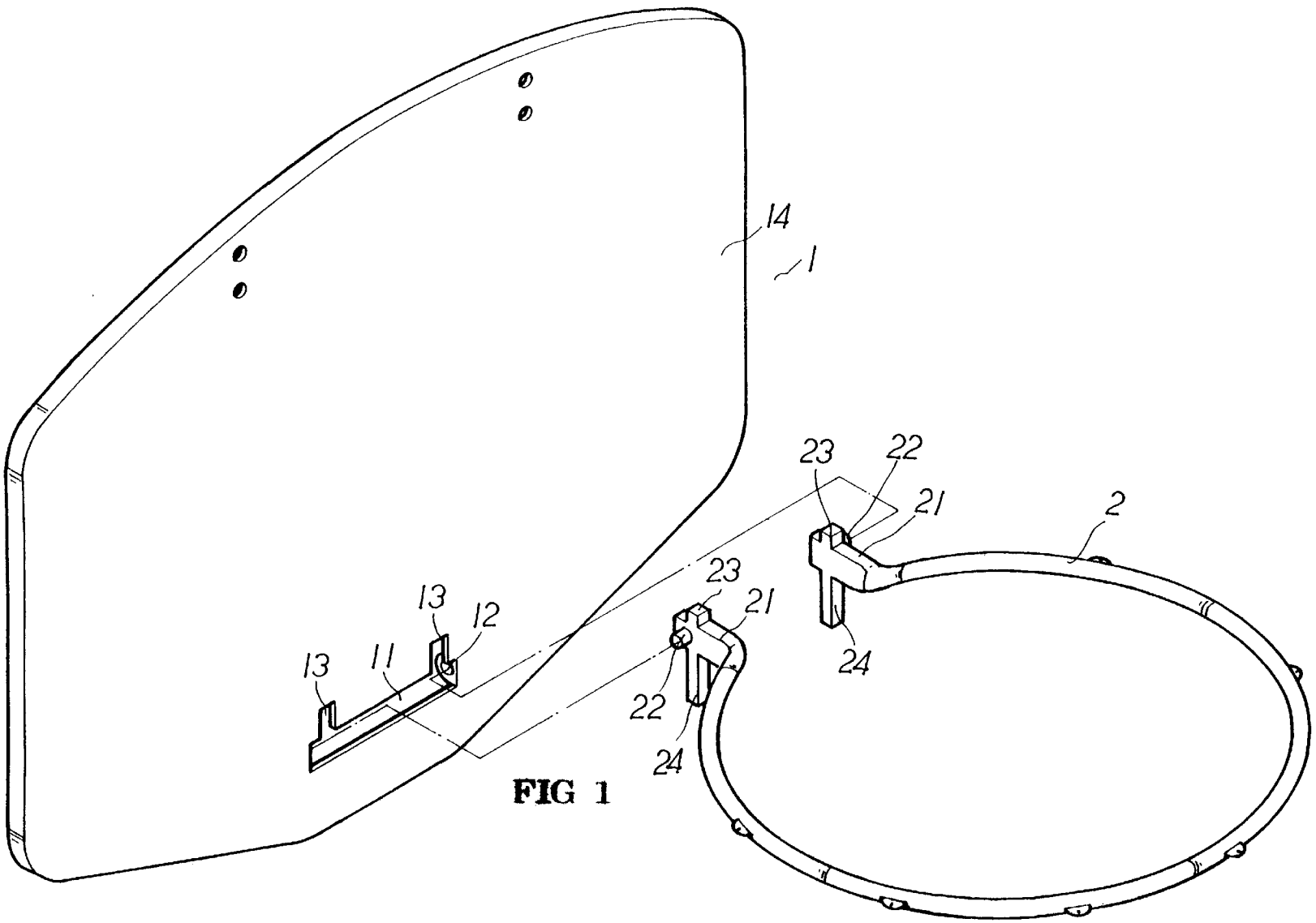
FIG. 1 is an exploded perspective view of the backboard assembly made according to the present invention.

Referring to FIGS. 1, 2, 3 and 5, a backboard assembly for basketball is shown from different aspects. The rim hoop ring can be readily attached to the backboard in a snapped manner without any fixed locking means.

The backboard assembly for basketball made according to the present invention generally include a backboard and a rim hoop ring.

The backboard 1 is provided with an elongate slot 11 in the lower middle portion. The back surface of the backboard is provided with a pair of projected sockets 12 which are spaced apart from each other and each of the sockets 12 is adjacent to the end portion of the elongate slot 11. Each of the sockets 12 is provided with a shaft hole 121 which is parallel to the longitudinal axis of the elongate slot 11. The elongate slot 11 is further provided with a pair of cutouts 13 which are spaced apart from each other and each of the cutouts 13 is adjacent to a respective end portion of the elongate slot 11.

The rim hoop ring 2 is made from either plastic or steel having an opening thereof. The opening of the rim hoop ring 2 is provided with a pair of mounting legs 21 which are directed outward. Each of the mounting legs 21 is further provided with a pin shaft 22 which is perpendicular to the mounting legs 21 and is pivotally received within the shaft hole 121 of the socket 12 of the backboard 1. Each of the mounting legs 21 is further provided with a stopping boss 23 at a top surface and a supporting leg 24 at a bottom surface.

Normally, the span between the mounting legs 21 is wider than the length of the elongate slot 11. As a result, in assembling, the rim hoop ring 2 is compressed inward such that the span between the mounting legs 21 is narrower than the length of the elongate slot 11. Consequently, the mounting legs 21 can be passed through the elongate slot It and finally the pin shaft 22 can be pivotally received within the shaft hole 121 of socket 12 after the external compressing force is released. After the pin shaft 22 of the mounting legs 21 of the rim hoop ring 2 is pivotally attached to the shaft hole 121 of the socket 12 of the backboard 1, the stopping boss 23 and the supporting legs 24 are tightly pressed against the front surface 14 of the backboard 1 such that the rim hoop ring 2 is tightly anchored onto the backboard 1.

Figure 2:
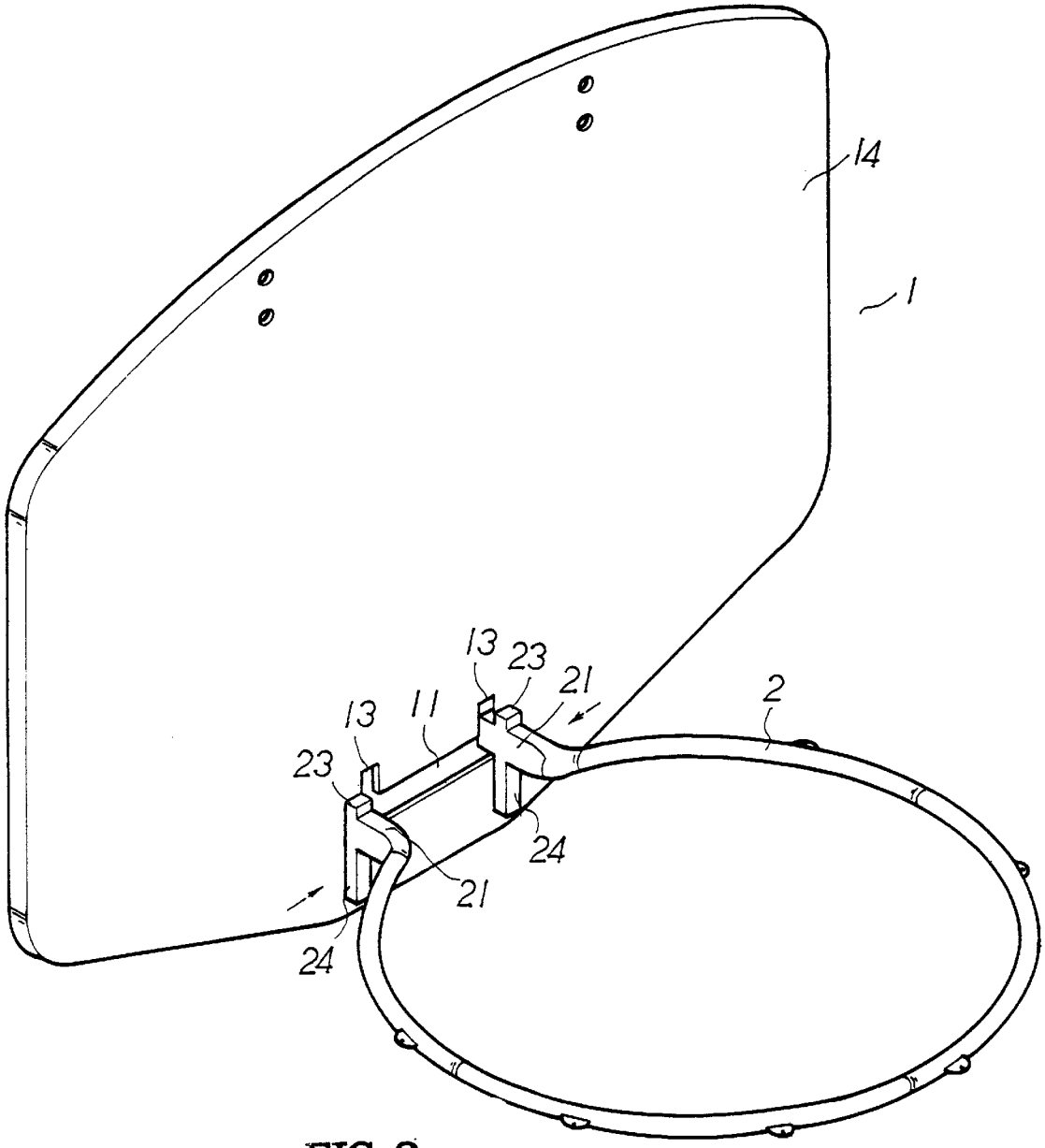
FIG. 2 is a perspective view of the backboard assembly shown in FIG. 1.
Figure 3:
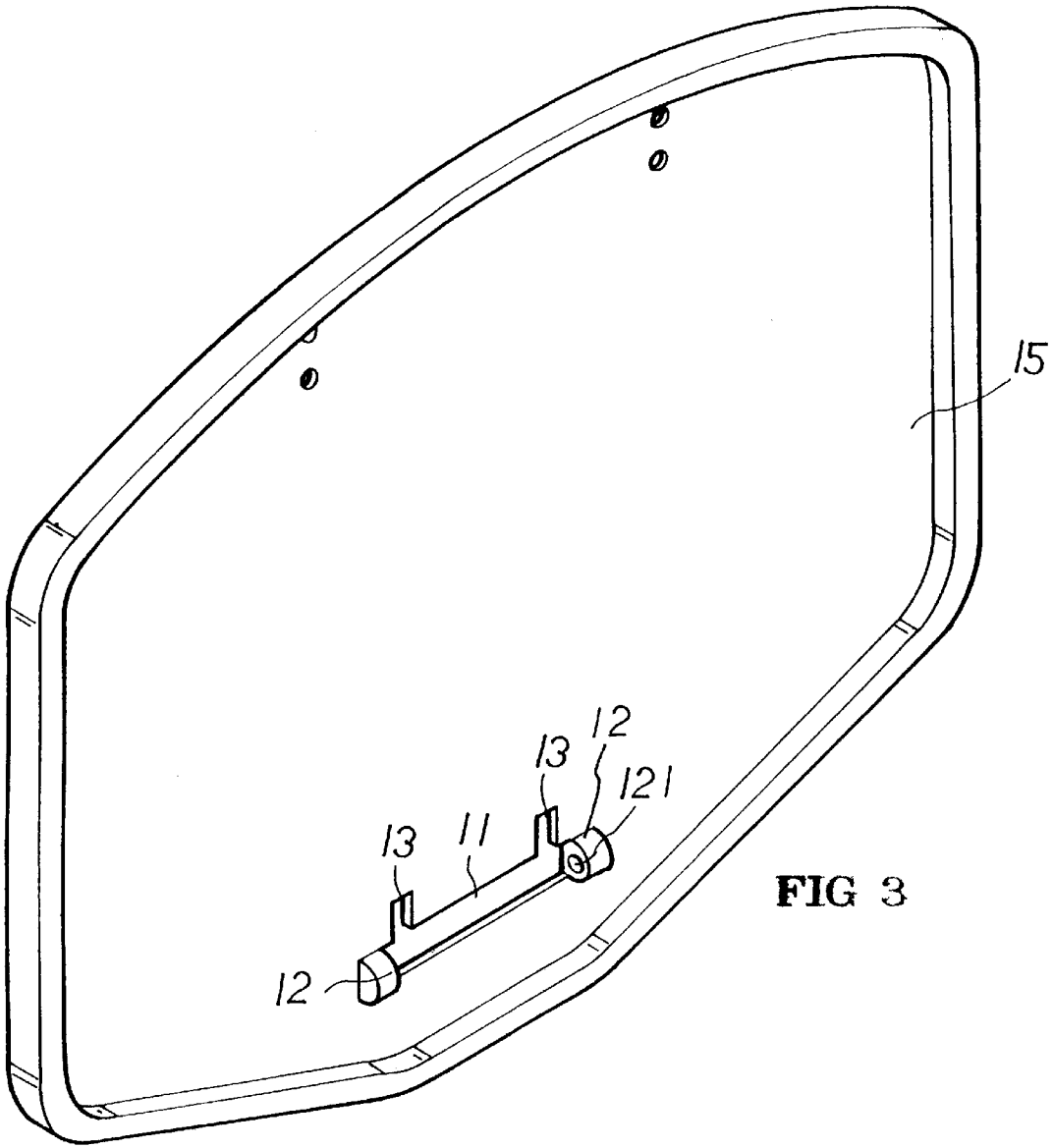
FIG. 3 is a rear view of the backboard assembly shown in FIG. 1.
Figure 4:
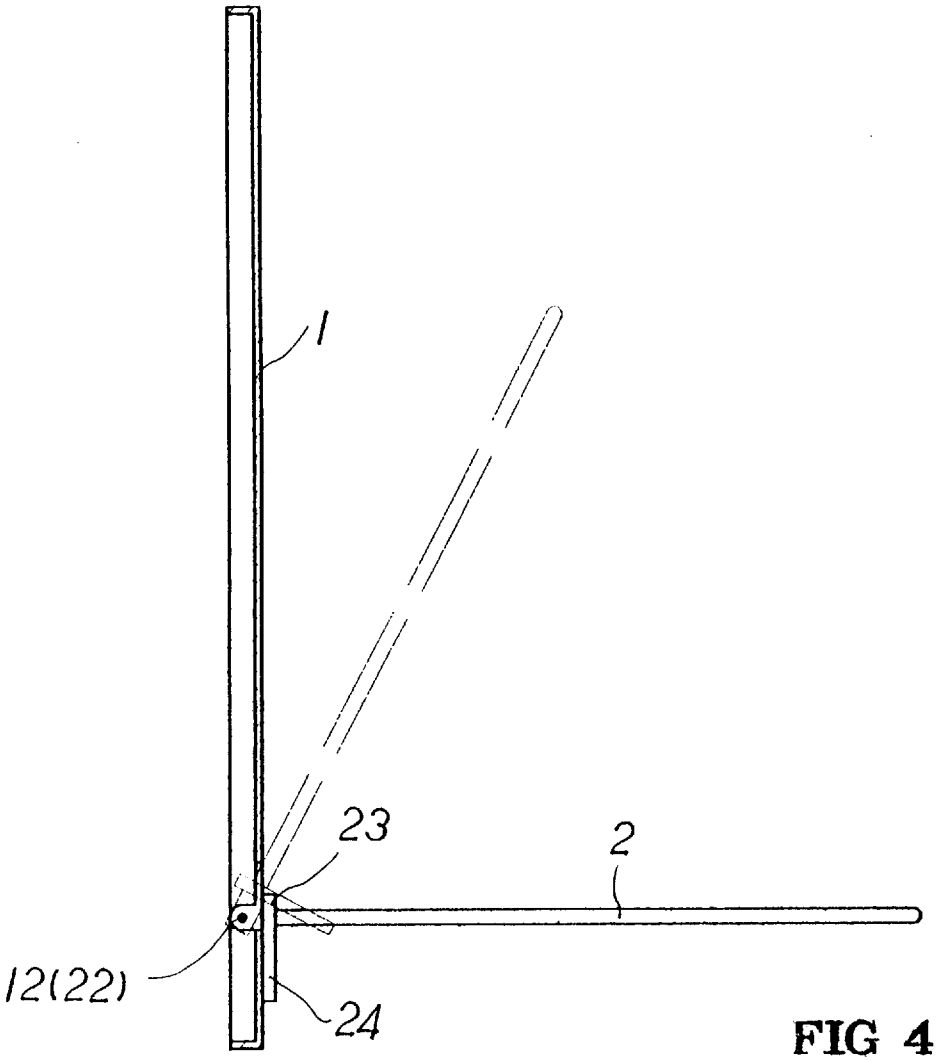
FIG. 4 is a schematic illustration of the backboard assembly when it is folded.
Figure 5:
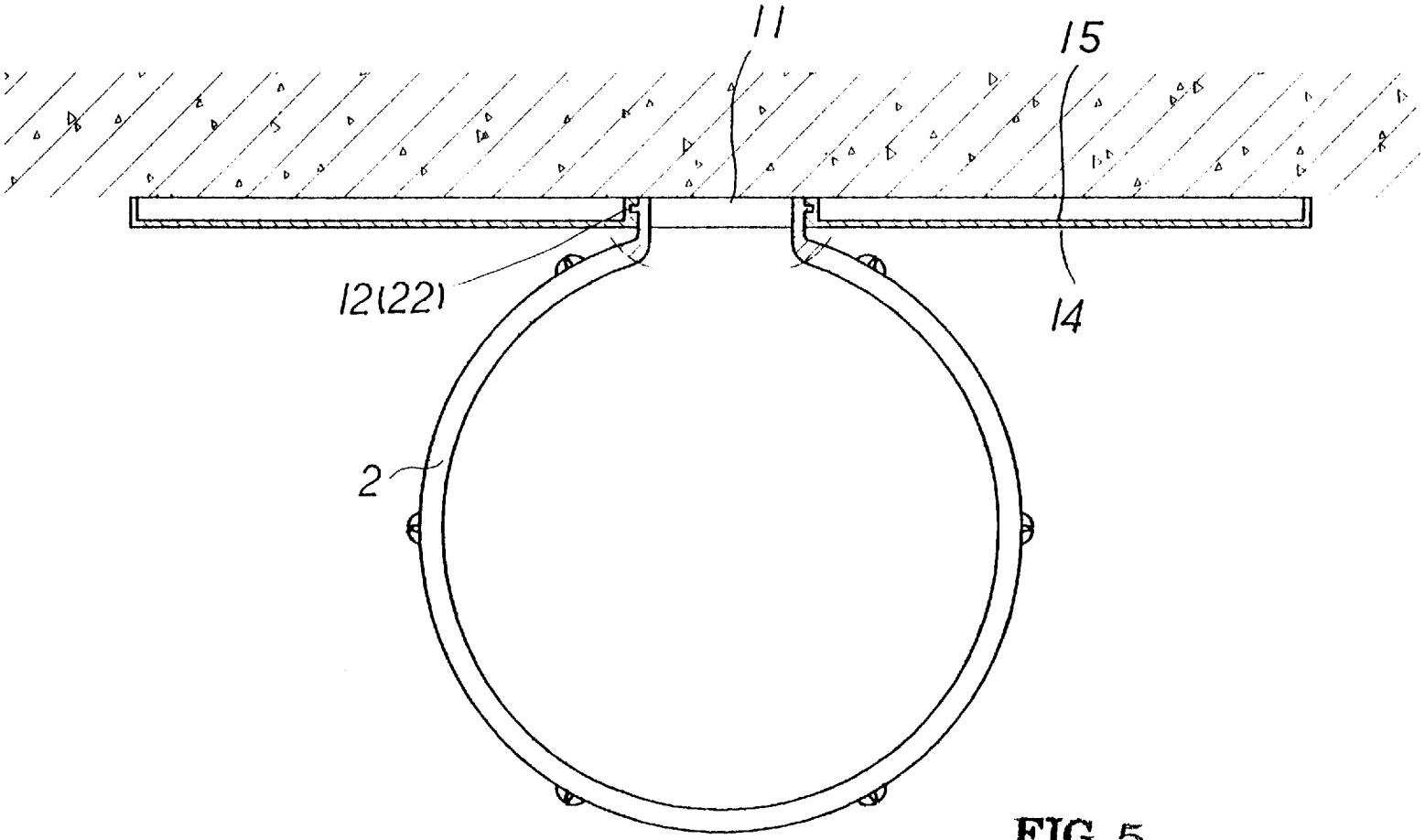
FIG. 5 is a cross sectional view of the backboard assembly viewed from top.

When the backboard assembly is not in use, the rim hoop ring 2 can be slightly compressed inward such that each of the stopping bosses 23 is aligned with a cutout 13 on the elongate slot 11, as shown in FIG. 2. As a result, the rim hoop ring 2 can be pivotally bent upward as the stopping boss 23 is received within the cutout 13.

Besides, the rim hoop ring is made from resilient material, once the rim hoop ring is compressed and installed onto the shaft hole/socket of the backboard, the pin shaft will not be removed therefrom as the pin shaft is tightly biased and installed within the shaft hole of the socket. On the other hand, the assembling of the rim hoop ring can be readily performed. Furthermore, no locking device is applied between the backboard and the rim hoop ring. The assembling job can be done in a short time and the manufacturing cost can be reduced.

While a particular embodiment of the present invention has been illustrated and described, it would be obvious to those skilled in the art that various other changes and modifications can be made without departing from the spirit and scope of the invention. It is therefore intended to cover in the appended claims all such changes and modifications that are within the scope of the present invention.

I claim:

1. A backboard assembly for basketball comprising:

a backboard having an elongate slot in a lower middle portion, said backboard having a back surface provided with a pair of projected sockets which are spaced apart from each other and each of said sockets being adjacent to an end portion of said elongate slot, each of said sockets including a shaft hole parallel to a longitudinal axis of said elongate slot, said elongate slot having a pair of cutouts which are spaced apart from each other and each of the cutouts being adjacent to an end portion of said elongate slot; and a rim hoop ring defining an opening thereof and having a pair of mounting legs directed outward, each of said mounting legs including a pin shaft which is pivotally received within said shaft hole of said socket of said backboard, each of said mounting legs being further provided with a stopping boss at a top surface and a supporting leg at a bottom surface which are pressed against said backboard when said rim hoop ring is pivotally mounted to said backboard by the pivotal engagement between said pin shaft and said shaft hole.

2. A backboard assembly for basketball as recited in claim 1, wherein said rim hoop ring is made from resilient material.

3. A backboard assembly for basketball as recited in claim 1, wherein the span between said two mounting legs is longer than the length of said elongate slot of said backboard.

4. A backboard assembly for basketball as recited in claim 1, wherein said stopping boss can be received within said cutout when said rim hoop ring is compressed inward and pivoted upward.

* * * * *